US005853628A

United States Patent [19]

Varona

[11] Patent Number: 5,853,628

[45] Date of Patent: Dec. 29, 1998

[54] METHOD OF FORMING NONWOVEN FABRIC HAVING A PORE SIZE GRADIENT

[75] Inventor: Eugenio Go Varona, Marietta, Ga.

[73] Assignee: Kimberly-Clark Worldwide, Inc., Neenah, Wis.

[21] Appl. No.: 712,818

[22] Filed: Sep. 12, 1996

[51] Int. Cl.[6] ..... D04H 1/70

[52] U.S. Cl. ..... 264/6; 264/115; 264/518; 156/167

[58] Field of Search ..... 264/6, 518, 115; 156/167

[56] References Cited

U.S. PATENT DOCUMENTS

| | | | |
|---|---|---|---|
| 2,952,260 | 9/1960 | Burgeni | 128/290 |
| 3,338,992 | 8/1967 | Kinney | 264/24 |
| 3,341,394 | 9/1967 | Kinney | 161/72 |
| 3,502,538 | 3/1970 | Petersen | 161/150 |
| 3,502,763 | 3/1970 | Hartmann | 264/210 |
| 3,542,615 | 11/1970 | Dobo et al. | 156/181 |
| 3,565,729 | 2/1971 | Hartmann | 156/441 |
| 3,689,342 | 9/1972 | Vogt et al. | 156/167 |
| 3,692,618 | 9/1972 | Dorschner et al. | 161/72 |
| 3,752,613 | 8/1973 | Vogt et al. | 425/80 |
| 3,795,571 | 3/1974 | Prentice | 161/148 |
| 3,802,817 | 4/1974 | Matsuki et al. | 425/66 |
| 3,811,957 | 5/1974 | Buntin | 136/146 |
| 3,849,241 | 11/1974 | Butin et al. | 161/169 |
| 3,978,185 | 8/1976 | Buntin et al. | 264/93 |
| 4,112,167 | 9/1978 | Dake et al. | 428/154 |
| 4,340,563 | 7/1982 | Appel et al. | 264/518 |
| 4,375,446 | 3/1983 | Fujii et al. | 264/518 |
| 4,405,297 | 9/1983 | Appel et al. | 425/72 S |
| 4,656,081 | 4/1987 | Ando et al. | 428/233 |
| 4,713,069 | 12/1987 | Wang et al. | 604/378 |
| 4,738,675 | 4/1988 | Buckley et al. | 604/380 |
| 4,741,941 | 5/1988 | Englebert et al. | 428/71 |
| 4,921,659 | 5/1990 | Marshall et al. | 264/510 |
| 4,927,582 | 5/1990 | Bryson | 264/113 |
| 4,931,357 | 6/1990 | Marshall et al. | 428/284 |
| 4,999,232 | 3/1991 | LeVan | 428/113 |
| 5,227,107 | 7/1993 | Dickenson et al. | 264/113 |
| 5,330,456 | 7/1994 | Robinson | 604/368 |
| 5,342,335 | 8/1994 | Rhim | 604/367 |
| 5,409,768 | 4/1995 | Dickenson et al. | 428/283 |
| 5,575,874 | 11/1996 | Griesbach, III et al. | 156/167 |

*Primary Examiner*—Matthew O. Savage
*Attorney, Agent, or Firm*—William D. Herrick

[57] ABSTRACT

A method for forming a web structure having a pore size gradient which utilizes a spunbond process for producing fibers. The fibers are deposited on a contoured collection surface. Preferably, the surface is shaped as an elongated dome, having the central zone at the apex and the peripheral zones along the curved sides. The fibers are deposited onto the central zone and accumulate until they flow down the sides onto the peripheral zones. Fibers deposited onto the central zone have greater average pore size and fibers deposited onto the peripheral zone have smaller average pore size and greater fiber alignment. In an alternative embodiment, a plurality of dies in a row is used, each providing extruded fibers of distinct composition. Pore size gradient formation permits improved control of wicking and absorption over a web structure, such as a diaper or similar absorptive article. An alternative embodiment comprises providing a meltblown source of attenuated fibers, preferably co-formed with fluff.

29 Claims, 6 Drawing Sheets

METHOD OF FORMING NONWOVEN FABRIC HAVING A PORE SIZE GRADIENT

FIELD OF THE INVENTION

The present invention relates generally to a fibrous nonwoven web having a pore size gradient, and methods for forming such a web. The method of the present invention uses, in one embodiment, a spunbond process to form fibers which are deposited on a moving contoured support surface, the fibers being deposited in a central zone and migrate partially to peripheral zones. The fibers in the central zone have a lower degree of fiber alignment and thus a larger average pore size, while the fibers in the peripheral zones have a higher degree of fiber alignment and thus a smaller average pore size. A pore size gradient is thus created between the central zone and the peripheral zones, providing improved control of wicking and absorption characteristics.

BACKGROUND OF THE INVENTION

The manufacture of nonwoven fabrics is a highly developed art. In general, nonwoven webs or mats and their manufacture involve forming filaments or fibers and depositing them on a carrier in such a manner so as to cause the filaments or fibers to overlap or entangle as a web or mat of a desired basis weight. The bonding of such a web may be achieved simply by entanglement or by other means such as adhesive, application of heat and pressure to thermally responsive fibers, or, in some cases, by heat or pressure alone. While many variations within this general description are known, two commonly used processes are defined as spunbonding and meltblowing. Spunbonded nonwoven structures are defined in numerous patents including, for example, U.S. Pat. No. 3,802,817 to Matsuki et al., U.S. Pat. No. 3,565,729 to Hartman dated Feb. 23, 1971, U.S. Pat. No. 4,405,297 to Appel et al. dated Sep. 20, 1983, and U.S. Pat. No. 3,692,618 to Dorschner et al. dated Sep. 19, 1972. Discussion of the meltblowing process may also be found in a wide variety of sources including, for example an article entitled, "Superfine Thermoplastic Fibers" by Wendt in *Industrial and Engineering Chemistry*, Volume 48, No. 8 (1956) pp. 1342–1346, as well as U.S. Pat. No. 3,978,185 to Buntin et al. dated Aug. 31, 1976, U.S. Pat. No. 3,795,571 to Prentice dated Mar. 5, 1974, and U.S. Pat. No. 3,811,957 to Buntin dated May 21, 1974.

Among the characteristics of the web produced by either a meltblown or a spunbond process are the fiber diameter, which may also be expressed as the "denier" of the fiber as well as the wicking power of the fabric, which relates to the ability of the web to pull moisture from an area of application to another location. The ability to wick moisture is related to the denier of the fiber and the size and density of the pores in the material. Wicking is caused by the capillary action of the interstices between fibers in contact with one another. The pulling or capillary action is inversely related to the size of the interstices. Therefore, the smaller the capillary size the higher the pressure and the greater the pulling or wicking power, in general.

It has been found useful to create a fabric having a composition containing a pore size gradient over a selected portion of the fabric. An advantage of this is greater control over fluid wicking in target areas. Several patents have attempted to address methods of creating nonwoven fabrics of variable pore size.

U.S. Pat. No. 4,375,446 to Fujii et al. discloses a meltblown process in which fibers are blown into a valley created between two drum plates, the plates having pores. One drum is a collection plate and the other drum is a press plate; the fibers are pressed between the two drums. The angle at which the fibers are shot into the valley is discussed as creating mats of varying characteristics.

U.S. Pat. No. 4,999,232 to LeVan discloses a stretchable batting composed of differentially-shrinkable bicomponent fibers, which form cross-lapping webs at determined angles. The angle determines the degree of stretch and cross direction orientation. A helical crimp is induced into the material by the differential shrinking.

U.S. Pat. No. 2,952,260 to Burgeni discloses an absorbent product, such as a sanitary napkin, having three layers of webs folded over each other; each layer has different shaped bands of porous zones of compacted or uncompacted fibers.

U.S. Pat. No. 4,112,167 to Dake et al. discloses a web including a wiping zone having a low density and high void volume. The low density zone is heated with a lipophilic cleansing emollient. The web is made by drying two layers of slurry formed webs.

U.S. Pat. No. 4,713,069 to Wang et al. discloses a baffle having a central zone having a water vapor transmission rate less than that of non-central zones of the baffle. The baffle can be formed by melt blowing or a laminate of spunbonded web layers, or by coating the central zone with a composition.

U.S. Pat. No. 4,738,675 to Buckley et al. discloses a multiple layer disposable diaper having compressed and uncompressed regions. The compressed regions can be created by embossing by rollers.

U.S. Pat. Nos. 4,921,659 and 4,931,357 to Marshall et al. disclose a method of forming a web using a variable transverse webber. Two independent fiber sources (one short fiber, one long fiber) are rolled and fed by feed rolls to a central mixing zone. The relative feed rates of the feed rolls is controllable to alter the fiber composition of the web formed therefrom.

U.S. Pat. No. 4,927,582 to Bryson discloses a graduated distribution of granule materials in a fiber mat, which is formed by introducing granules of high-absorbency material whose flow is regulated into a flow of fibrous material which intermix in a forming chamber. The controllable flow velocity permits selective distribution of high-absorbency material within the fibrous material deposited onto the forming layer.

U.S. Pat. No. 5,227,107 to Dickenson et al. discloses a multi-component nonwoven made by directing fibers from a first and a second fiber source throughout a forming chamber such that they mix to form a relatively uniform fibrous precursor which is then deposited from the forming chamber onto a forming surface such that a fibrous nonwoven web is made which is a mixture of the first and second fibers.

U.S. Pat. No. 5,330,456 to Robinson discloses an absorbent panel having a fibrous absorbent panel layer of super absorbent polymer (SAP) and a liquid transfer layer, the latter of which is positioned above the SAP layer.

U.S. Pat. No. 4,741,941 to Englebert et al. discloses a nonwoven web formed by depositing fibers onto a collecting surface, the surface having an array of projections extending therefrom. The fibers form over the projections resulting in a web having projections, with the projections being separated by land areas of interbonded fibers, and the fiber orientation is greater in the projections than in the land areas.

Fabrics created by multilayer processes can have difficulties transferring fluids between layers due to the interlayer barrier caused by imperfect wicking between the layers. Fabrics created by differential compression of various areas can also have associated disadvantages because pattern bond areas tend to be film-like and impede liquid transfer. Additionally, compression reduces the capacity of the web at the compressed point or area.

It would be desirable to have a method of controllably creating a variable pore size material that could utilize existing methods of creating the web. Such a web would have improved flow and wicking characteristics that would enhance a fluid absorbing product's ability to absorb fluid in a target area and wick the fluid rapidly away to distant areas. Such a web would have enhanced wicking rates and capacities.

SUMMARY OF THE INVENTION

The present invention provides a nonwoven fibrous web having a pore size gradient. The web has improved wicking and absorption properties and improves control over target zone creation versus remote fluid storage zones. Larger pore size areas absorb fluids more rapidly and smaller pore size areas wick fluids more efficiently.

The present invention also provides methods of forming a nonwoven web having a pore size gradient. In a preferred embodiment fibers produced by a spunbond process are attenuated and deposited onto a moving contoured forming surface. The surface is preferably convex dome shaped having a central zone about the apex and peripheral zones on the sides of the dome. Other contours are possible. The surface is supported by a plurality of rollers, each roller preferably having a complementary surface for maintaining the surface contour. The fibers are deposited across the dome surface such that fibers in the central zone have less alignment and a correspondingly larger average pore size. Fibers deposited towards the peripheral zones have greater alignment and a correspondingly smaller average pore size. The fibers are collected on a collection roll. In this manner the deposited fibers gradually decrease average pore size from the central to the peripheral zones. Accordingly, fluids are absorbed more efficiently and wicked from the central zone to the peripheral zones. In a diaper, the central zone would correspond to the target fluid absorption area.

The spinneret can be oriented in the normal orientation with respect to the surface, or tilted or angled horizontally to produce webs with different properties.

In an alternative embodiment, a meltblown process is used to form fibers which are deposited onto the apex area of the domed surface. The fibers can contain fluff or SAP. Fibers are deposited about the apex and partially migrate down the sides. Fibers about the apex have greater fiber randomization and less alignment, with correspondingly larger average pore size. Fibers which migrate down the sides have greater alignment and correspondingly smaller average pore size.

Accordingly, it is an object of the present invention to provide a method of forming a nonwoven fibrous web having a controllable pore size gradient.

It is another object of the present invention to provide a method using a spunbond process for forming a web having a pore size gradient having improved wicking and absorption properties.

It is a further object of the present invention to provide a method using a meltblown process for forming a web having a pore size gradient having improved wicking and absorption properties.

It is yet another object of the present invention to provide a moving contoured forming surface upon which fibers can be deposited, such that fiber alignment is lesser in a central zone of the surface and greater in peripheral zones, resulting in a gradient of average pore size decreasing from the central zone to the peripheral zones.

Other objects, features, and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DEFINITIONS

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "meltblown fibers" means fibers formed by extruding a molten thermoplastic material through a plurality of fine, usually circular, die capillaries as molten threads or filaments into converging high velocity gas (e.g., air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers are microfibers which may be continuous or discontinuous, are generally smaller than 10 microns in average diameter, and are generally tacky when deposited onto a collecting surface.

As used herein the term "spunbonded fibers" refers to small diameter fibers which are formed by extruding molten thermoplastic material as filaments from a plurality of fine, usually circular capillaries of a spinneret with the diameter of the extruded filaments then being rapidly reduced as by attenuation, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos.

3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al. Spunbond fibers are generally not tacky when they are deposited onto a collecting surface. Spunbond fibers are generally continuous and have average diameters larger than 7 microns, more particularly, between about 10 and 20 microns.

As used herein the term "polymer" generally includes but is not limited to, homopolymers, copolymers, such as for example, block, graft, random and alternating copolymers, terpolymers, etc. and blends and modifications thereof Furthermore, unless otherwise specifically limited, the term "polymer" shall include all possible geometrical configurations of the molecule. These configurations include, but are not limited to isotactic, syndiotactic and random symmetries.

DESCRIPTION OF THE PREFERRED EMBODIMENTS

Generally described, the present invention provides a web having a pore size gradient within the web structure and a method of making same.

Figure 1:
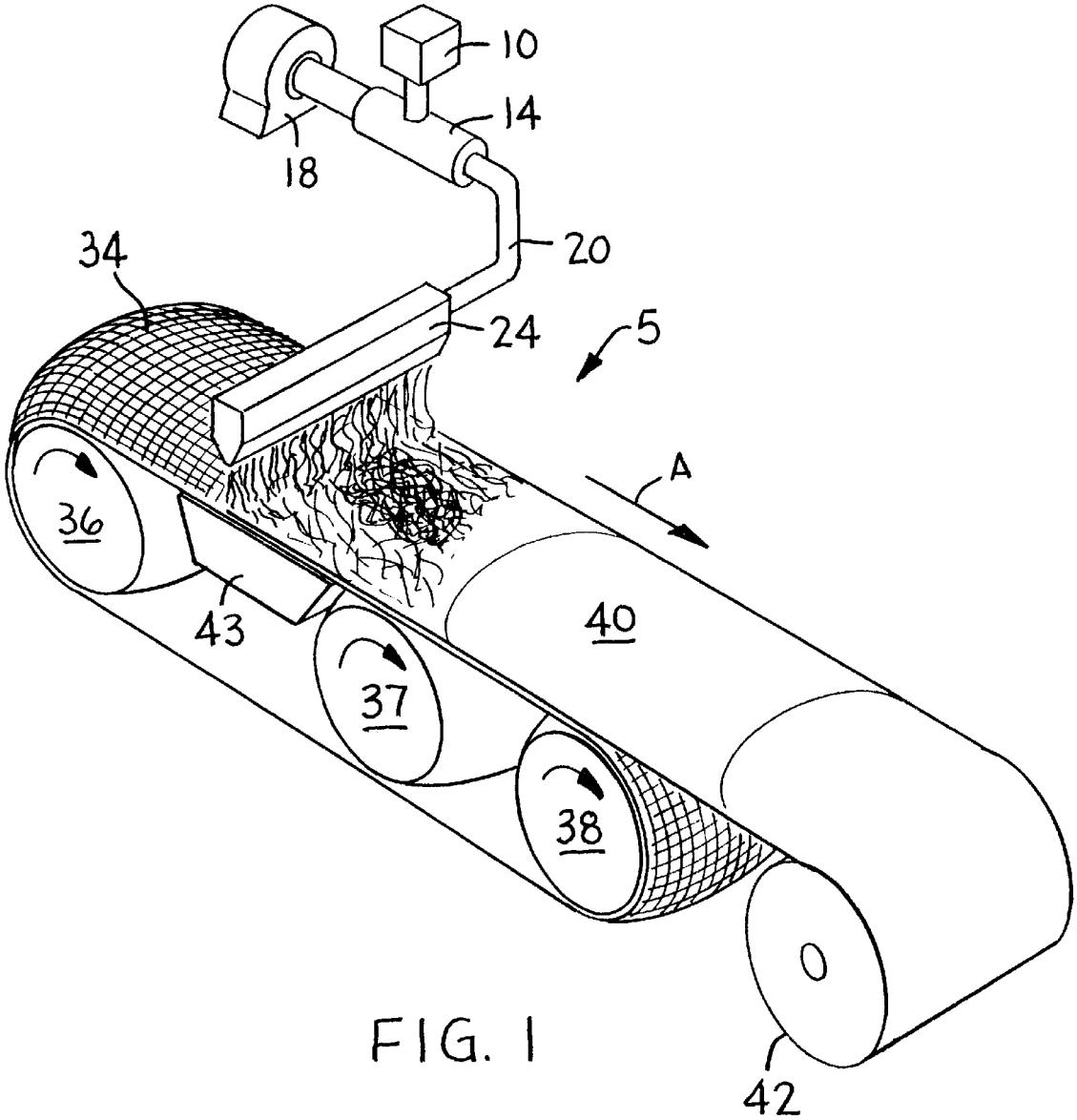
FIG. 1 shows a perspective view of an apparatus of a preferred embodiment of the present invention showing a convex forming surface.

In a preferred embodiment of the present invention, a spunbond process is used. Spunbond processes are known to those skilled in the art and need not be described in detail. Briefly, however, FIG. 1 shows an apparatus 5, in which a hopper 10 feeds polymer in the form of thermoplastic resin pellets to a screw extruder 14. The polymer can be any suitable material such as, but not limited to, thermoplastic polymers, including polyolefins, polyesters, polyamides, and blends and copolymers, biconstituent or bicomponent mixtures thereof, and the like. The extruder 14 is heated along its length to the melting temperature of the pellets 12 to form a melt. The screw extruder 14 driven by a motor 18 forces the molten resin material through the extruder 14 into an attached delivery pipe 20 a spunbond unit 24. The spunbond unit 24 draws the resin into fibers, which are quenched within the spunbond unit 24. A fiber draw unit within the spunbond unit 24 receives the quenched fibers. The fiber draw unit may include an elongate vertical passage through which the filaments are drawn by aspirating air entering the spunbond unit 24 and flowing downwardly through the passage. A heater may supply hot air to the fiber draw unit. The heated aspirating air draws the fibers and ambient air through the fiber draw unit. The fibers are deposited onto an endless wire forming surface 34 moving in the direction of arrow A. The surface 34 is disposed around support rolls 36, 37 and 38, at least one of which may be driven by means not shown, such as a motor or the like. Each roller 36, 37 and 38 has a convex or crowned shape (which may be different depending on the shape of the wire mesh surface 34 desired), which maintains the shape of the surface 34.

Figure 1A:
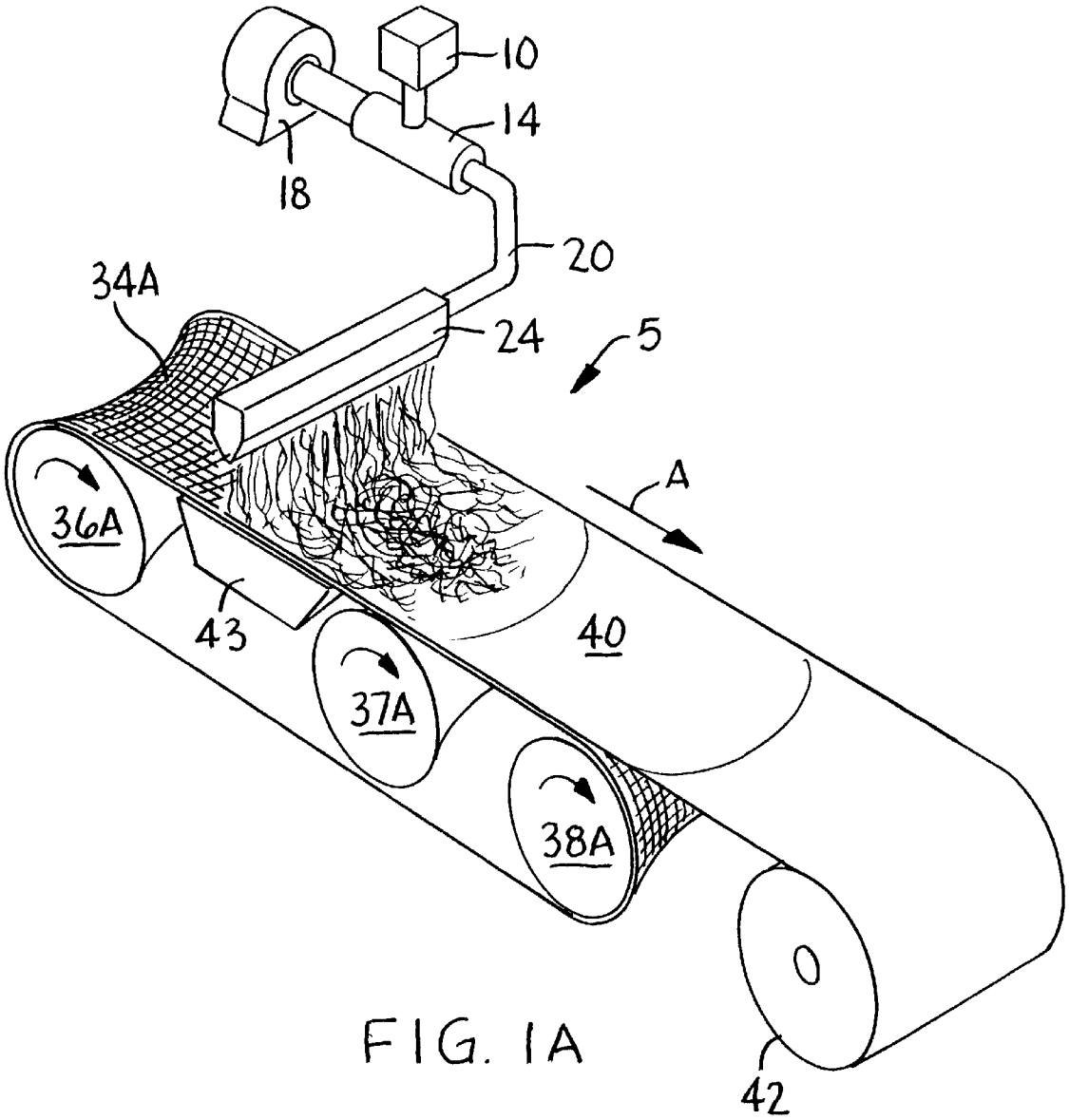
FIG. 1A shows a perspective view of an apparatus of an alternative to the preferred embodiment of the present invention showing a concave forming surface.

The surface 34 is preferably a wire mesh structure capable of retaining its shape or assuming the shape of a shaped support surface. The wire mesh can be formed into any of a number of shapes, including, but not limited to, dome, parabola, hyperbola, inverted cone, multiples or combinations thereof or variable contour shapes. A three-dimensional asymmetrical shape can also be formed to create a web structure having a defined contour. For example, a diaper can be created having a pocket for containing bowel movement, or, an anatomically shaped product can be designed for feminine care applications. Other forms are contemplated as being within the scope of the present application. For the purpose of illustrating the present invention, a domed convex structure will be described. FIG. 1A shows an alternative embodiment in which the forming surface 34A is concave shaped, with accompanying designed rollers 36A, 37A and 38A to support the concave surface.

It is preferable that the surface 34 have sides at an angle of from about 5° to about 45°. More preferably, the angle is from about 10° to about 30°, with 30° being optimal. Other angles are contemplated as being usable with more complex or irregular surface topology.

The fibers are deposited on the moving surface 34 (the direction of which is indicated by arrow A) to form a web 40. The web 40 is collected after setting by a collection roll 42. A vacuum box 43 assists in drawing the fibers onto the surface 34 to form the web 40 and maintain the web 40 in place on the surface 34.

Figure 2:
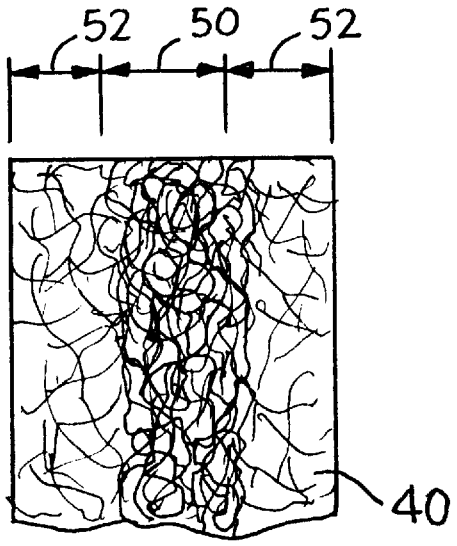
FIG. 2 shows a top schematic view of the collection surface of FIG. 1.
Figure 3:
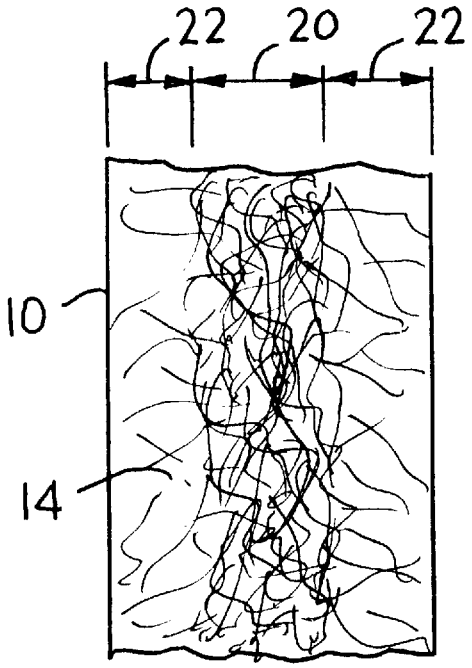
FIG. 3 shows a top schematic view of a fiber web formed according to the first preferred embodiment of the present invention.

The area on the surface 34 onto which the fibers are deposited onto determines the extent of fiber alignment and therefore pore size distribution. A central zone 50 and peripheral zones 52 of the surface 34 are shown in FIG. 2. Because fibers deposited in the central zone 50 fall on a more horizontal surface, the fibers tend not to migrate appreciably. The central zone 50 has relatively random fiber distribution, larger interstices and thus larger average pore size. Fibers deposited onto the peripheral zones 52 of the surface 34 are directed downward and contact an angled surface. The fibers flow down the sides of the surface 34 under the force of air flow (from the fiber draw unit 30 and the vacuum box 39) and gravity until viscosity or setting force cause the fibers to remain in place in the peripheral zones 52. The movement of the fibers creates relatively greater fiber alignment, smaller interstices and thus smaller average pore size. In the example of a convex curve shaped surface 34, there is a continuous angle of curvature resulting in a gradual gradient of less to more aligned fibers as one progresses from the central zone 50 outward to the peripheral zones 52, producing a web 40 having a pore size gradient, as shown in FIG. 3.

While fluff can be added in this embodiment, its presence is less critical because a spinneret having a relatively broad width is used for fiber deposition rather than a point source of fibers. As such, significant layering at a point of deposition does not occur and ordinarily fluff is not required to disrupt fiber alignment. It is to be understood, however, that each method has its advantages, depending on the product desired and that fluff may be employed under appropriate conditions.

Figure 4:
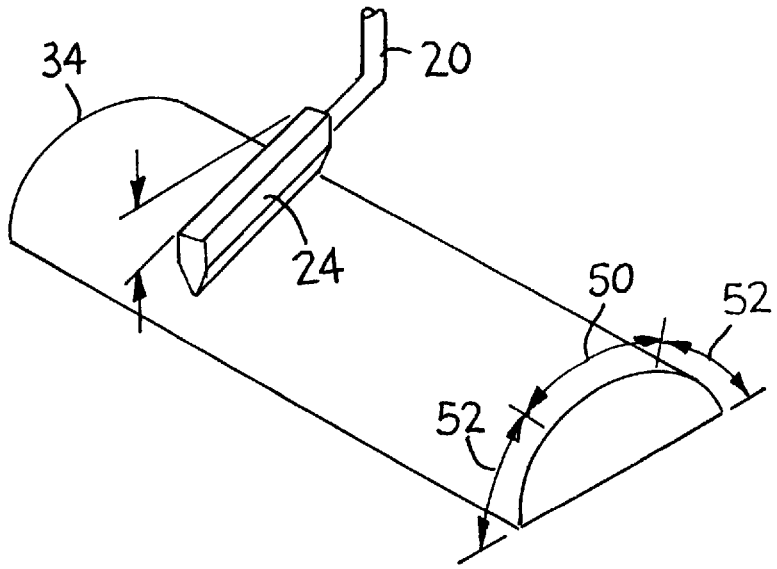
FIG. 4 shows a perspective view of a detail of an apparatus wherein the die is tilted at an angle.
Figure 5:
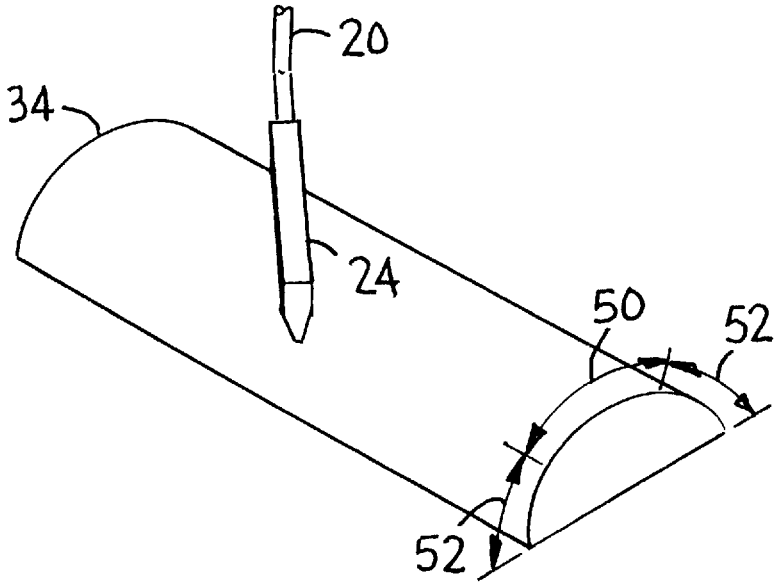
FIG. 5 shows a perspective view of a detail of an apparatus wherein the die is rotated at an angle.

FIGS. 4 and 5 show the spunbond unit 24 in different orientations, which may be useful in creating different web characteristics. In FIG. 4 the spunbond unit 24 is tilted so that one edge is closer to the surface 34 than the other edge. In FIG. 5 the spunbond unit 24 is angled horizontally with respect to the surface 34. Other orientations of the spunbond unit are contemplated as being within the scope of the present invention.

In this first preferred embodiment and variations, the spunbond unit 24 can produce fibers of a single denier by an aperture having a single diameter. In a variation of this embodiment, the spunbond unit 24 can have apertures (not shown) of different sizes across the width of the spunbond unit 24. In this manner the fiber diameter deposited on the surface 34 can be controlled for different purposes. This can be useful, for example, where drape is an issue in the central zone of a web structure, but not as critical for the peripheral zones. In such a case, aperture size may be smaller in the middle area of the spunbond unit 24 and larger toward the edges of the spunbond unit 24.

Figure 6:
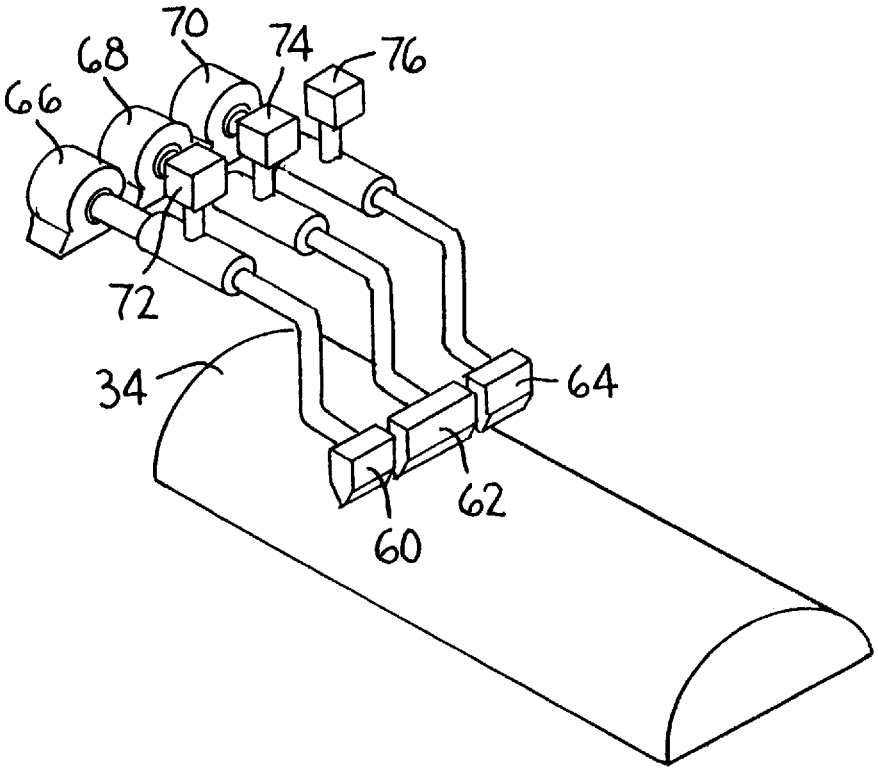
FIG. 6 shows a perspective view of an apparatus wherein a plurality of dies are employed.

In another variation of this embodiment, as shown in FIG. 6, a plurality of spunbond units 60, 62, and 64 can be used, each die producing fibers of a single denier and/or composition from hoppers 66, 68 and 70, respectively via conveyor and pipes 72, 74 and 76, respectively, as described hereinabove. Preferably, fibers to be deposited about the central zone 50 are larger in diameter than fibers to be deposited in the peripheral zones 52. In this embodiment, a pore size gradient is obtained with the additional control of different fiber composition. The composite web structure obtained may be used for many purposes, such as diapers or incontinence products.

Figure 8:
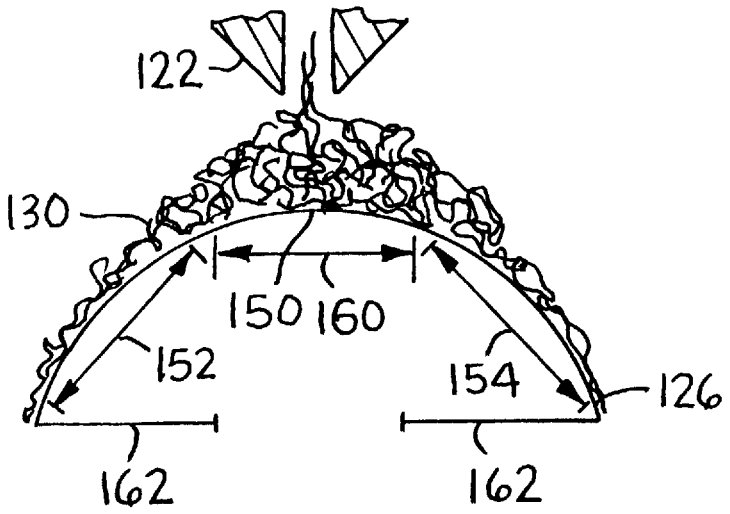
FIG. 8 shows a side schematic view of a collection surface and deposited fibers of FIG. 7.
Figure 7:
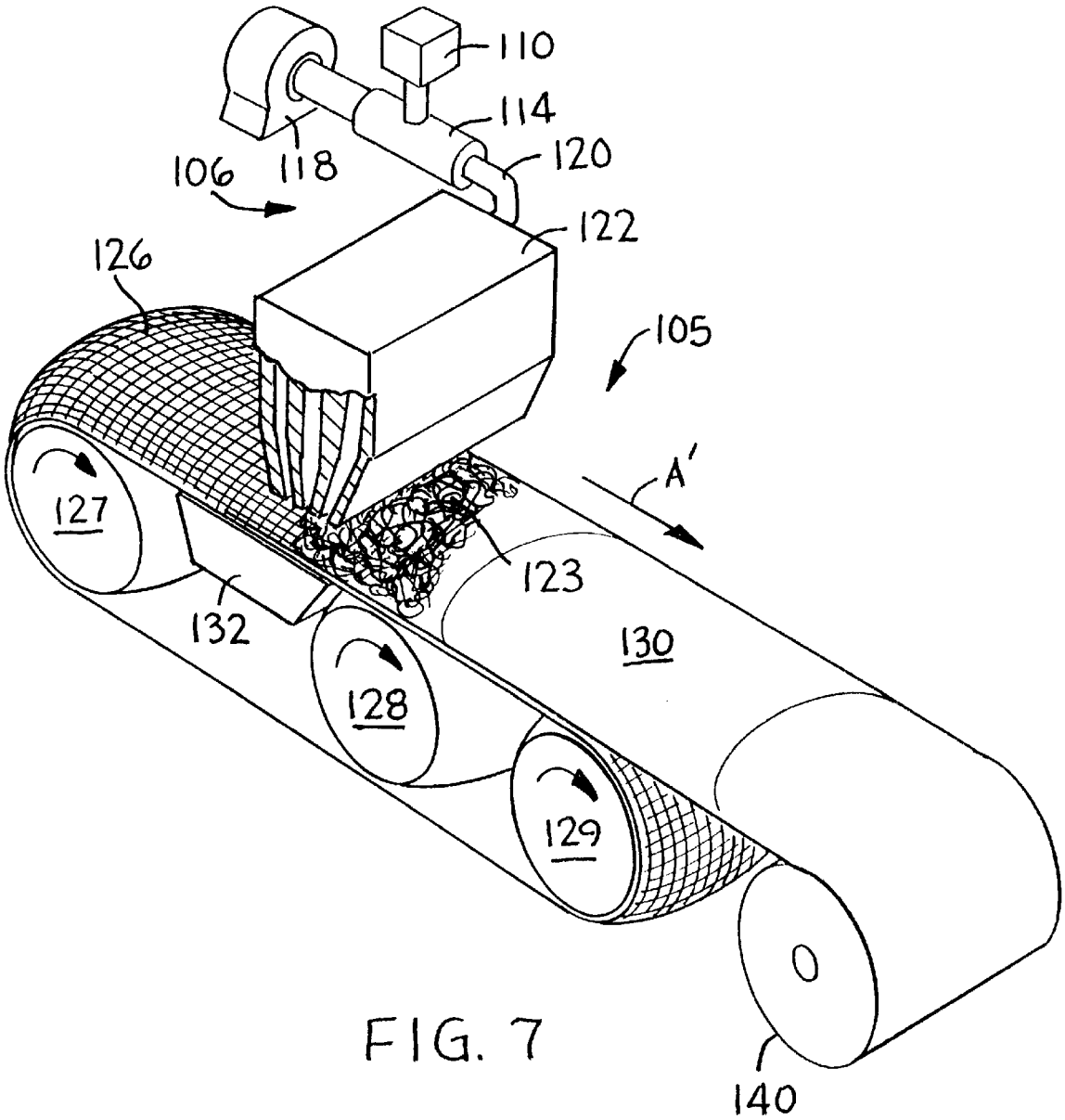
FIG. 7 shows a perspective view of an apparatus of a second preferred embodiment of the present invention.

In an alternative embodiment, molten fibers are produced using a conventional meltblown process. Such processes are known to those skilled in the art and need not be reviewed here in detail. Briefly, however, FIGS. 7 and 8 show an apparatus 105 having as part of a die assembly 106 a hopper 110 containing pellets (not shown) of a thermoplastic polymer resin. The polymer can be any suitable material such as, but not limited to, thermoplastic polymers, including those mentioned above. The pellets are transported to an extruder 114 which contains an internal screw conveyor. To the stream of molten fibers can optionally be added a co-forming material, such as wood pulp, commonly known as "fluff" (not shown) or other granular, flake or particulate matter. The material can also be any of a wide variety of known superabsorbent polymer ("SAP") particles or fibers.

The screw conveyor (not shown) is driven by a motor 118. The extruder 114 is heated along its length to the melting temperature of the thermoplastic resin pellets to form a melt. The screw conveyor driven by the motor 118 forces the molten resin material through the extruder 114 into an attached delivery pipe 120, each of which is connected to a die head 122. The die head 122 has a die width and a tip 123. Fibers are produced at the die head tip 123 in a conventional manner, i.e., using high pressure air to attenuate and break up the polymer stream to form a fiber stream at the die head 122, which fibers are deposited as an entangled stream on a wire forming surface 126. The surface 126 is preferably a wire mesh structure capable of retaining its shape or assuming the shape of a shaped support surface. The wire mesh can be formed into any of a number of shapes, including, but not limited to, dome, parabola, hyperbola, inverted cone, multiples or combinations thereof or variable contour shapes. A three-dimensional asymmetrical shape can also be formed to create a web structure having a defined contour. For example, a diaper can be created having a pocket for containing bowel movement, or, an anatomically shaped product can be designed for feminine care applications. Other forms are contemplated as being within the scope of the present application. For the purposes of illustrating the present invention, a domed convex structure will be described.

The surface 126 is, in a preferred embodiment, supported rollers 127, 128 and 129, as described hereinabove, each roller having a convex or crowned shape (which may be different depending on the shape of the wire mesh surface 126 desired), which maintains the shape of the surface 126. The fibers are deposited on the moving surface 126 (the direction of which is indicated by arrow A') to form a web 130. A vacuum box 132 is positioned beneath the surface 126 to draw the fibers onto the surface 126 during the process. The web 130 is collected after setting by a collection roll 140.

It is preferable that the surface 126 have sides at an angle of from about 5° to about 45°. More preferably, the angle is from about 10° to about 30°, with 30° being optimal. Other angles are contemplated as being usable with more complex or irregular surface topology.

FIG. 8 shows the fiber stream at the die head tip 124 is directed preferably downward at the apex 150 of the surface 126 and at an approximately 90° angle. As fibers are deposited onto the surface 126, the fibers accumulate about the apex 150 and flow over the surface 126, migrating down the sides 152 and 154. The extent of migration is dependent on several factors, including, but not limited to, amount of fiber being deposited, rate of deposition, duration of deposition, shape and size of the deposition surface, distance of the nozzle tip producing the fiber stream from the deposition surface, width or diameter of the fiber stream, density and composition of the fiber, fluff characteristics, composition of the deposition surface (e.g., electrostatic or surface charge, "stickiness," and the like), and the like.

The area of deposition on the surface 126 can be described in terms of a central zone designated generally as 160, located at and immediately surrounding the apex 150 of the surface, and, peripheral zones 162, located along the sides of the surface 126, as shown in FIG. 8. Fiber deposited in the central zone 160 has a higher fluff content, which interrupts filament formation, produces fewer, less aligned, fibers per unit area and a larger pore size structure. The result is a central web portion having a high absorbency.

The combination of the central zone 160 surrounded by the peripheral zone 162 results in a web structure having a controlled central target zone for fluid absorption and a surrounding peripheral zone for wicking fluid away from the central zone. A diaper made of this material would be able to absorb urine and other fluids more efficiently at the target zone and move the fluid by capillary action to a remote area to keep a baby or other user dry. An advantage of this method is also that the central zone 160 and peripheral zone 162 creation is controllable by the exemplative factors described hereinabove. Alteration of the deposition structure can thus permit variations in design of a gradient pore structure, depending on the material characteristics desired.

In a further alternative embodiment, a process known as solution spinning can be used to spin superabsorbent fibers in a single step, rather than co-forming with meltblown fibers in two steps. The superabsorbent fibers can thus be deposited using any appropriate die or manifold over a curved surface. Reference may be had to U.S. Pat. No. 5,342,335 issued to Rhim on 30 Aug. 1994, incorporated herein in its entirety, for discussion of solution spinning.

In general, an advantage of the present invention is the greater efficiency and control of fluid absorption and wicking in a web produced according to the aforementioned processes. Larger pore size areas can be used to absorb fluid at a target zone and adjacent smaller pore size areas can be used to wick fluid away from the target zone to a retention area. The retention area may have SAP incorporated therein for greater holding capacity. Such efficiency may be used in making diapers and feminine care product (such as sanitary napkins) where it is desired to absorb and move fluid away from a target zone to keep skin dry.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A method of forming a nonwoven web having a varying pore size gradient, comprising:

providing a foraminous shaped forming surface that is substantially linear in a machine direction along a first horizontal axis and that includes one of a concave or convex curvature along a second horizontal axis that is perpendicular to said first horizontal axis;

forming thermoplastic fibers;

directing the thermoplastic fibers at an angle of inclination relative to said second horizontal axis against said forming surface so as to form a web thereon, said forming surface having a central zone and at least one peripheral zone, wherein said central zone has a smaller angle of inclination relative to said second horizontal axis than an angle of inclination of said at least one peripheral zone such that said fibers in said central zone have less fiber alignment than fibers in said at least one peripheral zone resulting in a larger average pore size in said central zone than a pore size in said peripheral zone.

2. The method of claim 1, wherein said surface has an inclined portion defining an incline angle relative to said second horizontal axis between said central zone and said peripheral zone.

3. The method of claim 2, wherein said inclined portion has an apex and at least one side.

4. The method of claim 2, wherein said incline angle is about 5° to about 45°.

5. The method of claim 2, wherein said incline angle is about 10° to about 30°.

6. The method of claim 2, wherein said incline is at an angle of 30°.

7. The method of claim 2, wherein said central zone is defined by generally the area about said apex of said inclined portion and said at least one peripheral zone comprises said at least one side.

8. The method of claim 1, wherein said fibers are deposited generally uniformly across said central zone and said at least one peripheral zone.

9. The method of claim 8, wherein said fibers are formed by a melt spinning unit with a spinneret having a plurality of apertures.

10. The method of claim 9, wherein said spinneret is elongated.

11. The method of claim 9, wherein said spinneret is positioned generally parallel to said second horizontal axis.

12. The method of claim 9, wherein said spinneret is positioned at an angle with respect to said second horizontal axis.

13. The method of claim 9, wherein said melt spinning unit is a spunbond unit.

14. The method of claim 13, wherein said apertures have the same diameter.

15. The method of claim 13, wherein said apertures have at least two different diameters.

16. The method of claim 15, wherein said apertures comprises first zone of apertures having a first diameter and a second zone having apertures of second diameter.

17. The method of claim 1, wherein said gradient is continuous between said central zone and said peripheral zone.

18. A method of forming a non-woven web having a varying pore size gradient, comprising:

providing a foraminous shaped forming surface that is substantially linear in a machine direction along a first horizontal axis and that includes a convex curvature along a second horizontal axis that is perpendicular to said first horizontal axis;

forming thermoplastic fibers;

directing the thermoplastic fibers at an angle of inclination relative to said second horizontal axis against said forming surface so as to form a web thereon, said forming surface having an inclined portion that is inclined at an incline angle relative to said second horizontal axis and having an apex and at least one side, said apex defining a central deposition zone and said at least one side defining at least one peripheral deposition zone, wherein said central deposition zone has a smaller angle of inclination relative to said second horizontal axis than an angle of inclination of said at least one peripheral deposition zone such that said fibers deposited in said central deposition zone have less fiber alignment than fibers deposited in said at least one peripheral deposition zone resulting in a larger average pore size in said central deposition zone than a pore size in said peripheral deposition zone.

19. The method of claim 18, wherein said incline angle is about 5° to about 45°.

20. The method of claim 18, wherein said incline angle is about 10° to about 30°.

21. The method of claim 18, wherein said incline angle is 30°.

22. A method of forming a nonwoven web having a varying pore size gradient, comprising:

a) forming thermoplastic fibers by extruding molten thermoplastic polymer resin through a meltblown die;

b) providing a foraminous shaped forming surface that is substantially linear in a machine direction along a first horizontal axis and that includes a convex curvature along a second horizontal axis that is perpendicular to said first horizontal axis; said forming surface having an inclined portion that is inclined at an incline angle relative to said second horizontal axis and having an apex and at least one side, said apex defining a central deposition zone and said at least one peripheral deposition zone, wherein said central deposition zone has a smaller angle of inclination relative to said second horizontal axis than an angle of inclination of said at least one peripheral deposition zone;

c) directing the thermoplastic fibers at an angle of inclination relative to said second horizontal axis against said forming surface so as to form a web thereon, whereby at least a portion of said deposited fibers migrate down from said central deposition zone into said at least one peripheral zone such that said fibers in said central deposition zone have less fiber alignment than fibers in said at least one peripheral deposition zone resulting in a larger average pore size in said central deposition zone than a pore size in said peripheral deposition zone; and, d) separating said web from said forming surface.

23. The method of claim 22, wherein said incline angle is about 5° to about 45°.

24. The method of claim 22, wherein said incline angle is about 10° to about 30°.

25. The method of claim 22, wherein said incline angle is 30°.

26. The method of claim 22 further comprising the step of adding fluff to said resin.

27. The method of claim 22, wherein said collection surface is a shaped forming wire mesh.

28. The method of claim 22, wherein said collection surface comprises a dome-shaped surface.

29. The method of claim 22, wherein said gradient is continuous between said central deposition zone and said peripheral deposition zone.

* * * * *